US006279251B1

(12) United States Patent
Davis

(10) Patent No.: US 6,279,251 B1
(45) Date of Patent: Aug. 28, 2001

(54) SELF-ADJUSTING SHOE

(76) Inventor: Howard F. Davis, 45 W. 132nd St. Suite 3N, New York, NY (US) 10003

( * ) Notice: Subject to any disclaimer, the term of this patent is extended or adjusted under 35 U.S.C. 154(b) by 0 days.

(21) Appl. No.: 09/425,539

(22) Filed: Oct. 22, 1999

Related U.S. Application Data

(63) Continuation-in-part of application No. 09/179,581, filed on Oct. 27, 1998, now abandoned.
(60) Provisional application No. 60/065,946, filed on Oct. 27, 1997.

(51) Int. Cl.[7] ..... A43B 3/26
(52) U.S. Cl. ..... 36/97; 36/8.4; 36/68
(58) Field of Search ..... 36/8.4, 97, 44, 36/68

(56) References Cited

U.S. PATENT DOCUMENTS 1,752,254 * 3/1930 Gosnell .
2,126,608 * 8/1938 Brady .
2,464,571 * 3/1949 Gardner .
2,654,965 * 10/1953 Sloan et al. .
2,867,920 * 1/1959 Dube .
4,519,147 * 5/1985 Jones, Jr. .
5,060,402 * 10/1991 Rosen .
5,259,126 * 11/1993 Rosen .
5,554,694 * 9/1996 Crow .

FOREIGN PATENT DOCUMENTS

114882 * 3/1942 (AU) ..... 36/8.4

* cited by examiner

*Primary Examiner*—Ted Kavanaugh
(74) *Attorney, Agent, or Firm*—Cohen, Pontani, Lieberman & Pavane

(57) ABSTRACT

A shoe that includes an expansible inner lining that snugly conforms to the wearer's foot and that permits the wearer's foot to grow at least one shoe size, and preferably approximately two shoe sizes. The shoe may optionally include a midsole disposed between the insole and outsole. The shoe may also optionally include an expandable counter that permits the heel portion of the shoe to adapt as the wearer's foot grows. The inventive shoe thus permits the wearer's foot to grow or expand widthwise and/or lengthwise thereby reducing the frequency with which shoes must be replaced and without sacrificing fit, support and comfort. The expansible lining may be constructed of any four-way expandable, porous material. A transparent toe portion and a fit indicator may be provided to assist in determining when the wearer's foot has grown too large for the shoe.

22 Claims, 9 Drawing Sheets

SELF-ADJUSTING SHOE

RELATED APPLICATIONS

This application is a Continuation-in-Part of Utility Application No. 09/179,581 filed Oct. 27, 1998 now abandoned, which claims priority to Provisional Application Ser. No. 60/065,946 filed Oct. 27, 1997, the disclosures of which are expressly incorporated herein by reference.

BACKGROUND OF THE INVENTION

1. Field of the Invention

The present invention relates to shoes and, more particularly, to a shoe having expansible components that permit the shoe to automatically adjust in size as the wearer's foot grows without sacrificing comfort, support, or fit.

2. Description of the Prior Art

In general, shoes are designed to fit a specific size foot and may be made of an expansible or stretchable material which snugly, but comfortably holds the wearer's foot. However, if a wearer has an increasing foot size, such as a child, the shoes are not likely to fit the wearer's foot comfortably for very long. In some cases, the shoes will be barely worn before they no longer fit the child's foot. To prevent this, the shoe can be bought in a larger size so that the child grows into the shoe. But, in that case, for some period of time the child's foot is loose and may slide frontwards and backwards in the shoe. To prevent sliding, the laces of a shoe may be tied tightly so that the child's heel is held against the back of the shoe. However, this may cause discomfort for the child. Other reasons for variation in foot size include, by way of nonlimiting example, weight gain, weight loss, and water retention. Therefore, to reduce the frequency with which shoes must be replaced for the above reasons, a shoe is needed that will accommodate a certain amount of growth without sacrificing comfort, support, or fit.

SUMMARY OF THE INVENTION

The present invention relates to a shoe that includes an expansible inner lining positioned proximate the toe portion of the shoe that snugly conforms to the wearer's foot. The inner lining receives at least the toe portion of the wearer's foot and holds the wearer's foot against the heel end of the shoe. The inventive shoe is designed with a gap between the shoe upper and the expansible lining that permits the wearer's foot to stretch the lining. The variable size of the lining allows the shoe to accomodate a range of foot sizes spanning at least one shoe size, and preferably approximately two shoe sizes. Therefore, a user preferably buys the shoes when the wearer's feet are at the smaller end of the range of foot sizes which the shoe can accomodate. The user can wear these shoes until the wearer's feet grow to exceed the upper end of the range of foot sizes. This is especially useful for children's shoes but may also be used by adults, who may experience a variation in foot size for various medical reasons such, by way of non-limiting example, as weight gain, weight loss, and water retention.

The expansible lining used in the inventive shoe may comprise ½, ¾, or a fill length of the shoe upper or any other suitable size to securely and comfortably support the wearer's foot. The expansible lining may be made from any type of expandable material but is preferably made from a porous material such as an elastized, meshed nylon fabric. The expansible lining of the shoe is secured to the sole of the shoe which includes an outsole and may optionally include a midsole.

A counter located at the heel portion of the inventive shoe, may also include an expandable element having a plurality of fingers extending in a substantially upward and vertical direction away from the heel in addition to or instead of the expansible lining. The expandable counter is configured to expand and permit the shoe to accommodate the wearer's foot as the foot grows while still providing a comfortable and supportive shoe. The plurality of fingers are preferably strong enough to provide support to the wearer's heel but, are also flexible enough to accommodate growth of the wearer's foot. The inventive shoe thus accomodates the wearer's foot as it grows or expands widthwise and/or lengthwise within a range of sizes, thereby reducing the frequency with which shoes must be replaced and without sacrificing fit, support or comfort.

The toe portion of the inventive shoe may optionally be transparent and may include a fit indicator to permit viewing of the expansible lining and to enable the wearer or another to determine when new shoes are required, i.e., when the wearer's foot has outgrown the shoe.

Other objects and features of the present invention will become apparent from the following detailed description considered in conjunction with the accompanying drawings. It is to be understood, however, that the drawings are not necessarily drawn to scale and are designed solely for purposes of illustration and not as a definition of the limits of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
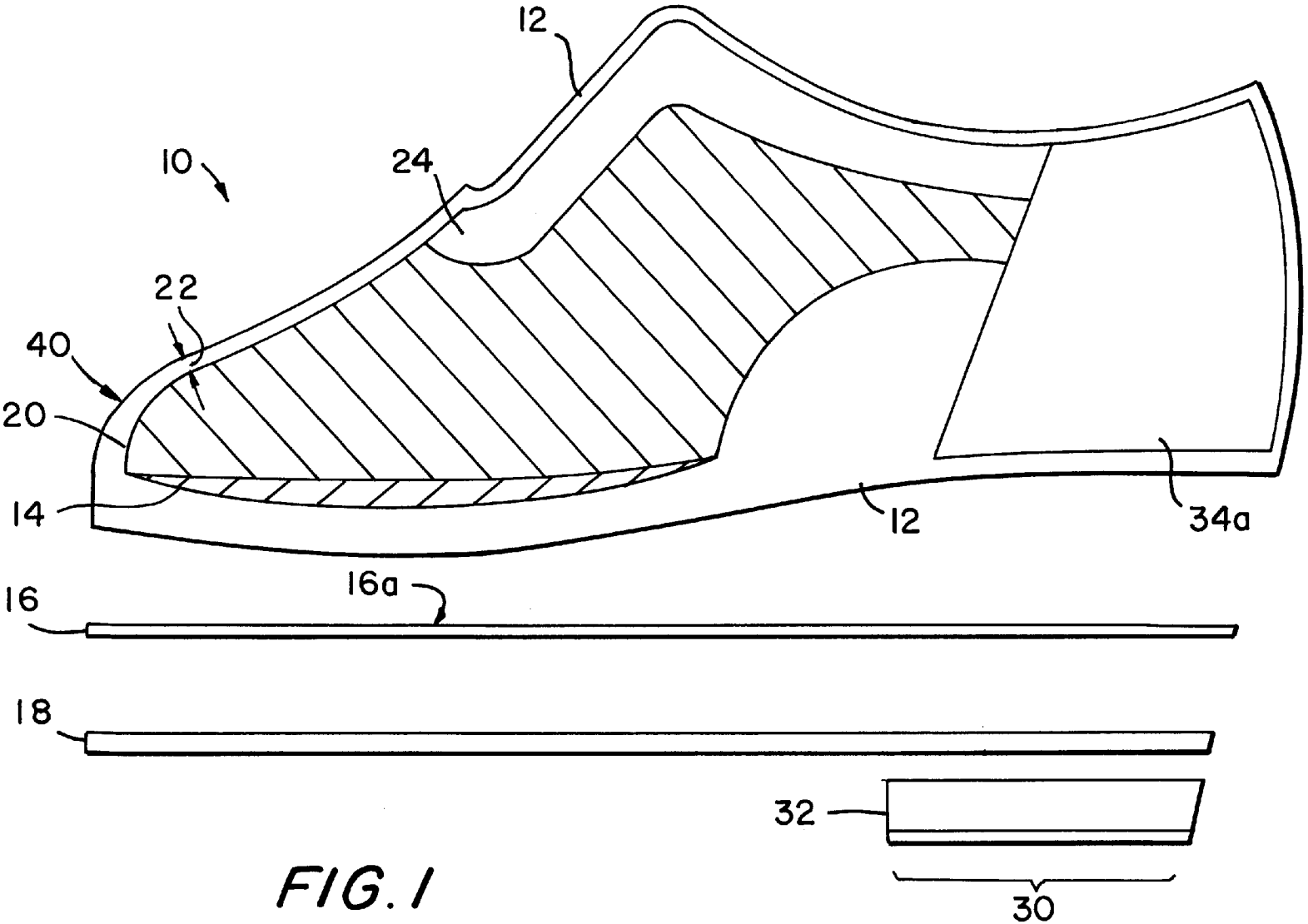
FIG. 1 is an exploded partial cutaway side view of a shoe having an expansible lining according to an embodiment of the present invention.

FIG. 1 depicts a shoe 10 according to a first embodiment of the present invention. The shoe 10 includes an upper 12 constructed of "glove" leather or other similar expansible or stretchable material. In this embodiment, an expansible lining 20 extends from near a toe portion 40 to a counter 34*a* of the shoe 10. The expansible lining 20 is preferably constructed of a four-way stretch material comprising an elasticized, meshed nylon fabric, although other porous and expansible materials may be used as the expansible lining 20. The term "four-way stretch" indicates that the material stretches in opposing directions along two axes on a plane of the expansive lining. An upper portion of the lining 20 is connected to a collar lining 24 comprising leather or fabric.

Figure 2:
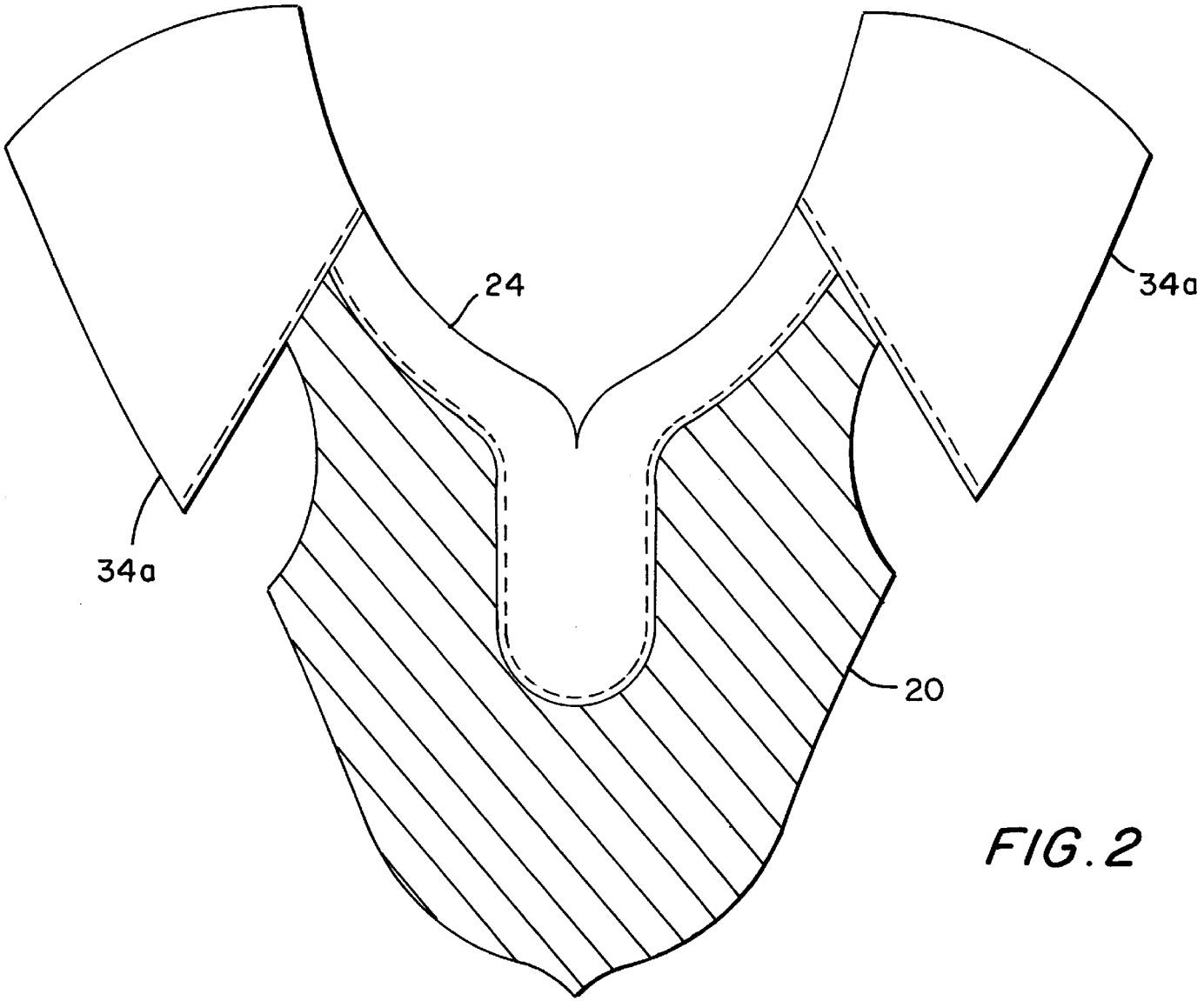
FIG. 2 is a plan view of a lining assembly for the shoe shown in FIG. 1.

A sole portion of the shoe 10 comprises an outsole 18 and a midsole 16 arranged between the outsole 18 and the upper 12. Furthermore, an insole 14 comprising the expansible material of the expansible lining 20 is stitched onto the expansible lining 20 so that the expansible lining 20, the collar lining 24, the counter lining 34*a* and the insole 14 form a sock-type unit 26. The toe portion of a wearer's foot is inserted between the insole 14 and the expansible lining 20 when inserted in the shoe 10. The inventive shoe 10 may be assembled, for example, by attaching the expansible lining 20, such as by sewing, stitching, or gluing to the collar lining 24 and the counter 34*a*. The assembly of the expansible lining 20, the counter 34*a* and the collar lining 24 is shown in FIG. 2. The insole 14 is then stitched to the expansible lining 20 to form the sock-type unit 26 which is inserted in the upper 12 and stitched to the upper 12 at a front opening and top line of the upper. After this, the sock-type unit 26 and upper 12 are sandwich lasted. That is, the lining 20 is arranged between the last and the upper 12. The midsole 16, the outsole 18, and the optional heel 30 are connected to the upper 12 using a normal manufacturing procedure such as by sewing, stitching, or gluing. Attachment among these various components may be by any suitable attachment means such as, by way of non-limiting example, a suitable adhesive, sewing or stitching. After the shoe 10 is removed from the last, the rear portion of the insole 14 is connected to the midsole 16, such as by stitching, to keep the insole 14 in the proper position. The lining 20 and the insole 14 forward of the connections are free to allow stretch and mobility.

The peripheries of the upper 12, midsole 16 and outsole 18 located near the toe portion 40 of the shoe are larger than the expansible lining 20 when the lining 20 is deployed in an unexpanded condition to accommodate a range of sizes of a wearer's foot—preferably about ¼-inch to about 5/16-inch. In a preferred embodiment, the difference in size between the unexpanded expansible lining 20 and the upper 12, midsole 16 and outsole 18 allows the shoe 10 to accommodate a range of foot sizes spanning as much as two standard shoe sizes. A gap 22 is thereby defined between the expansible lining 20 and the upper 12 located proximate the toe portion 40 of the shoe 10. The gap 22 accomodates a wearer's foot as the foot grows both lengthwise and widthwise, most preferably to accommodate a range of foot sizes spanning at least one shoe size and preferably spanning approximately two shoe sizes. The expansible lining 20 supportably receives a toe portion of the wearer's foot and holds the heel portion of the wearer's foot against the heel portion 30 of the shoe 10. The lining expands as much as necessary toward the toe portion of the shoe upper 12 to accommodate the size of the wearer's foot. Thus, it is possible, in accordance with the present invention, to provide a shoe 10 that accepts a range of foot sizes spanning up to two shoe sizes while still providing a comfortable, supportive and well-fitting shoe, such that a wearer's foot may grow and or expand from the smallest size to the largest size. The acceptance of a range of shoe sizes is especially important for children's shoes where the child's foot typically grows out of the shoe before the shoe wears out. Similarly, if a change in foot size is anticipated for an adult because of, for example, weight loss, weight gain, or water retention, the shoe 10 may be bought at the appropriate end of the range for accomodating the anticipated change in foot size.

Figure 3:
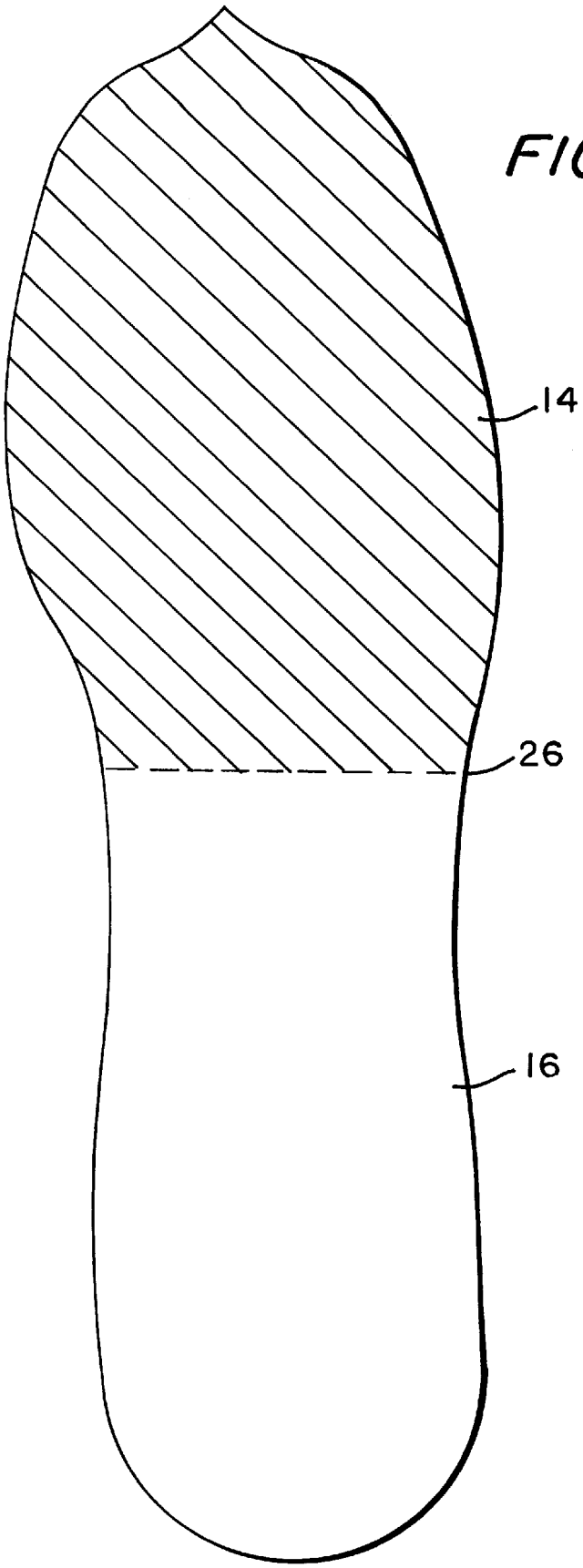
FIG. 3 is a plan view of the midsole and insole shown in FIG. 1 showing the connection of the insole to the midsole.
Figure 4A:
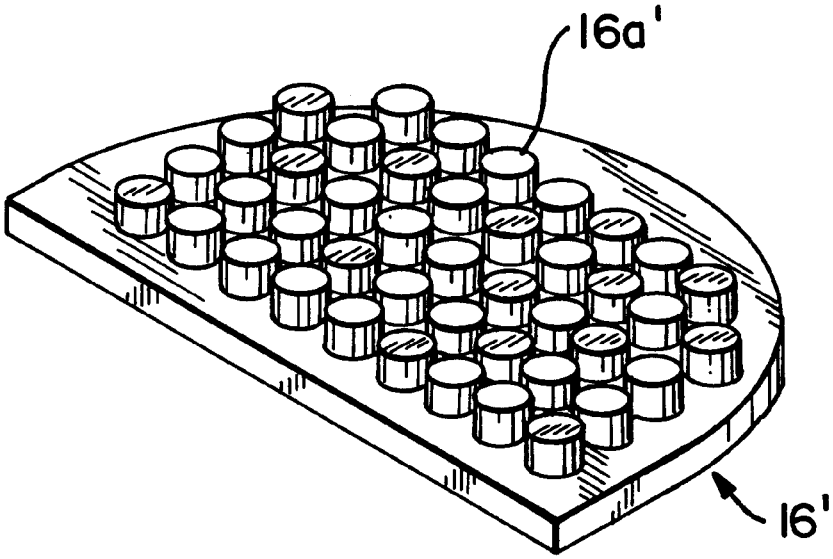
FIGS. 4*a* and 4*b* show two respective embodiments of a surface of the midsole in FIG. 1.
Figure 4B:
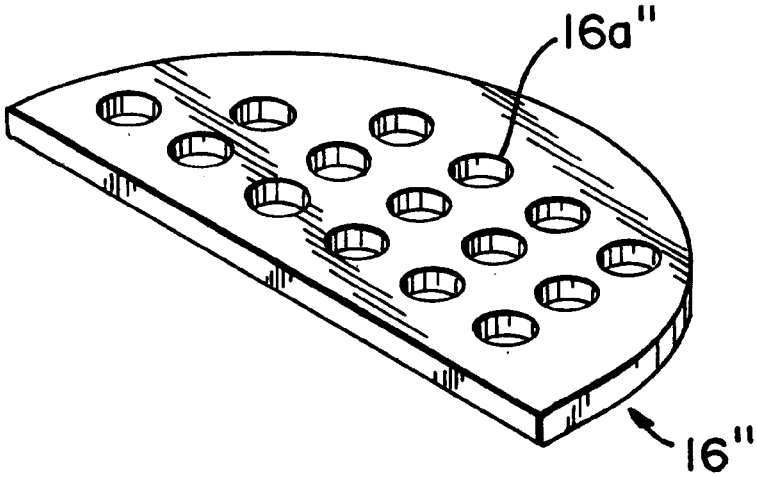

In the embodiment of the shoe 10 shown in FIGS. 1–3, the insole 14 is stretchable with the expansible lining 20. A further embodiment of the present invention includes a midsole 16 having a surface 16*a* facing the insole 14 which prevents the insole 14 from sliding forward when the wearer's weight is bearing on the shoe 10. When a wearer's foot is in the lower end of the range of sizes that can be accomodated, there is a gap between the lining 20 and the upper 12. However, the surface 16*a* of the midsole 16 may be selected such that a large coefficient of friction is present between the midsole 16 and the insole 14, thereby preventing the wearer's foot from sliding forward in the shoe 10 during use. The midsole 16 may comprise suede or rubber for this purpose. In a further embodiment, another midsole 16' may be used which comprises a surface 16*a'* having projections as shown in FIG. 4*a*. Yet another midsole 16" shown in FIG. 4*b* which comprises a surface 16*a"* having depressions as shown in FIG. 4*b*.

Figure 5:
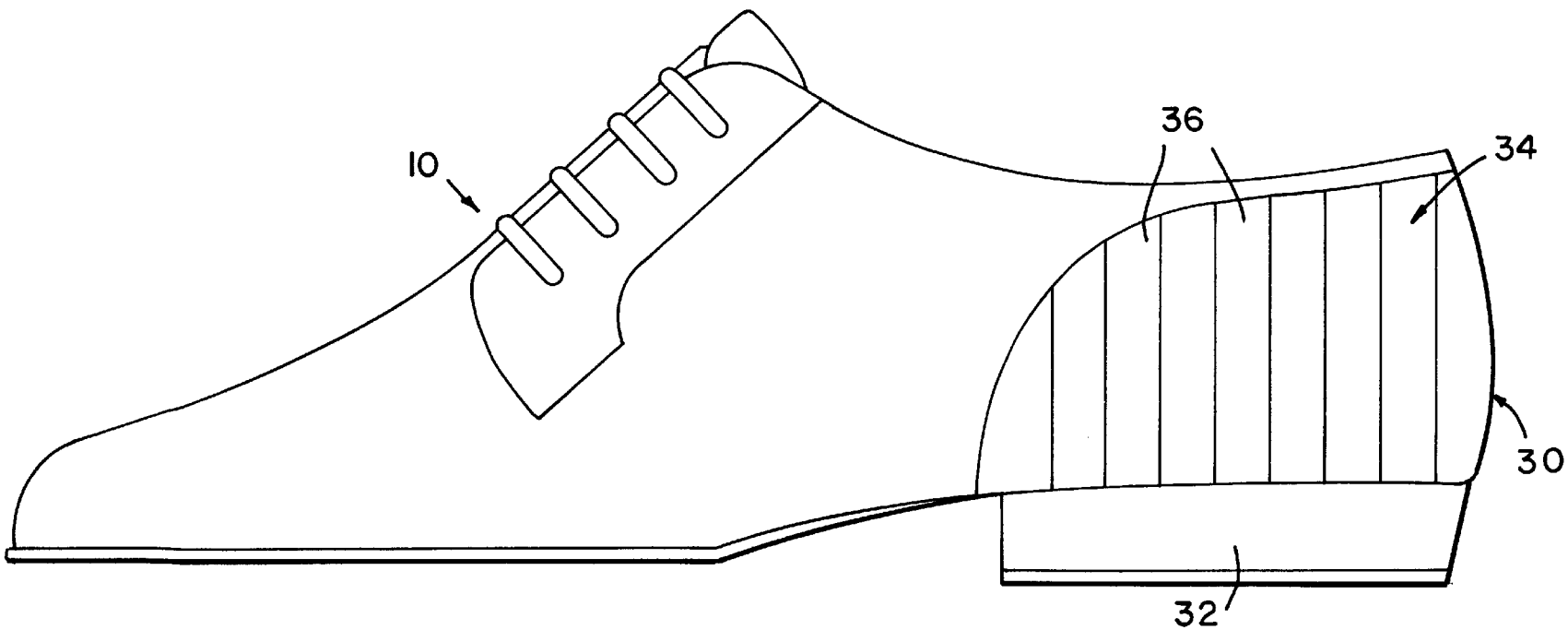
FIG. 5 is a partial cross-sectional side view of a shoe having an expansible counter located in the heel portion and configured in accordance with the present invention.
Figure 6:
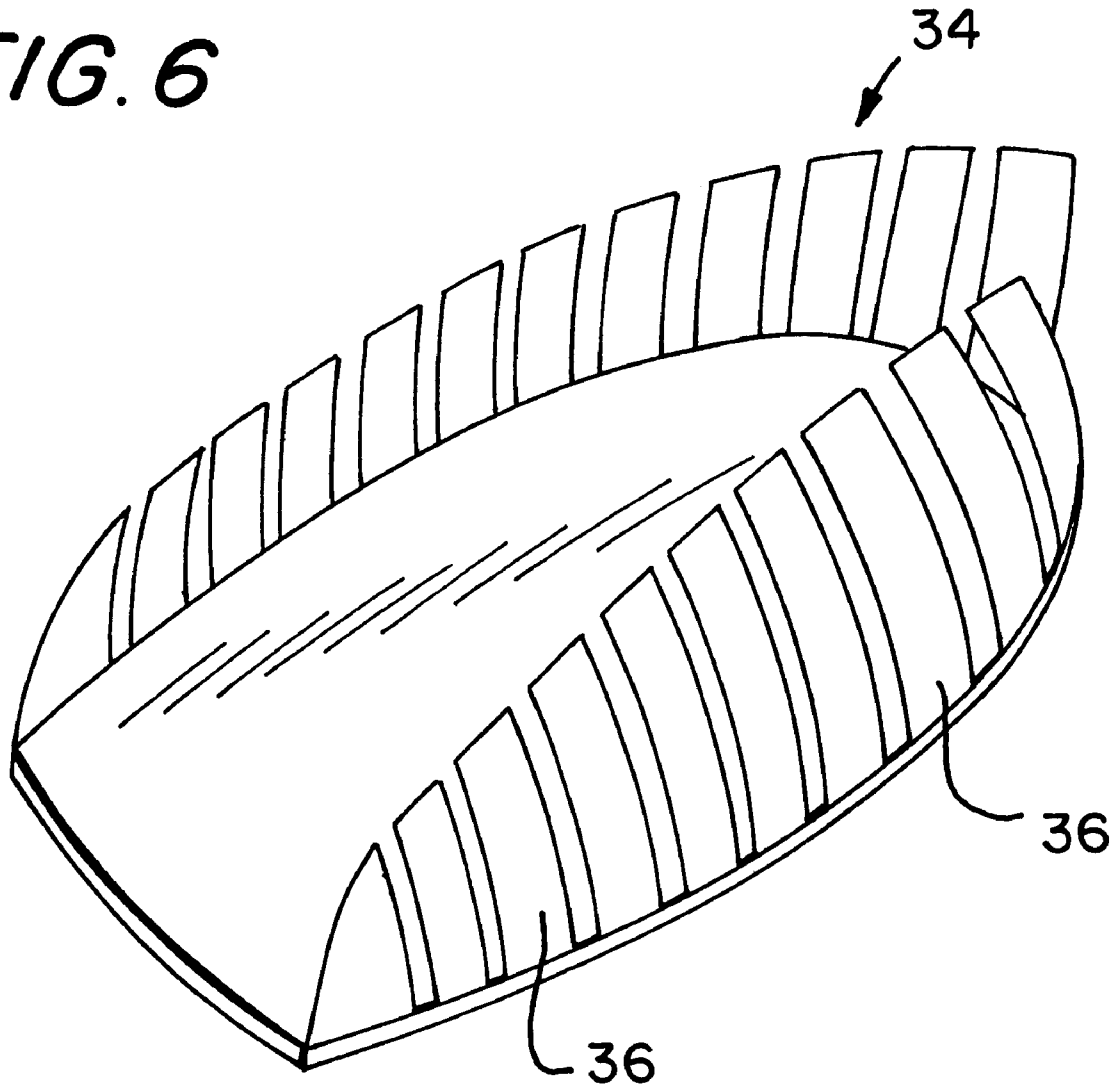
FIG. 6 is an isometric view of the counter of FIG. 5.

In a further embodiment of the present invention depicted in FIGS. 5 and 6, the shoe may additionally comprise a counter 34 having a plurality of upwardly extending fingers 36 provided in the heel portion 30 of the shoe 10. In general, the counter of a shoe is generally designed as a stiffener to provide a permanent form at the heel end of the shoe. It is usually one of the stronger portions of the shoe because it must retain its form during waling and running motions of the wearer. Accordingly, the counter should be strong enough to support the wearer's heel during impact which occurs during walking and running. Therefore, the plural fingers 36 of the counter 34 are designed to be flexible enough to permit the heel portion 30 of the shoe 10 to expand to accommodate a range of foot sizes and strong enough to provide the required support. The counter 34 is preferably made of plastic and is disposed between the upper 12 and an inner lining (not shown) located on the inside of the heel portion 30 so that the counter does not directly contact the wearer's foot. Instead of plastic, the counter may be made of any other material or compound that provides the required strength for supporting the heel. The counter 34 may be secured to the insole 14, midsole 16 or outsole 18 such as, for example, by sewing, stitching, or gluing. The counter 34 may also be additionally secured to the upper 12.

Figure 7:
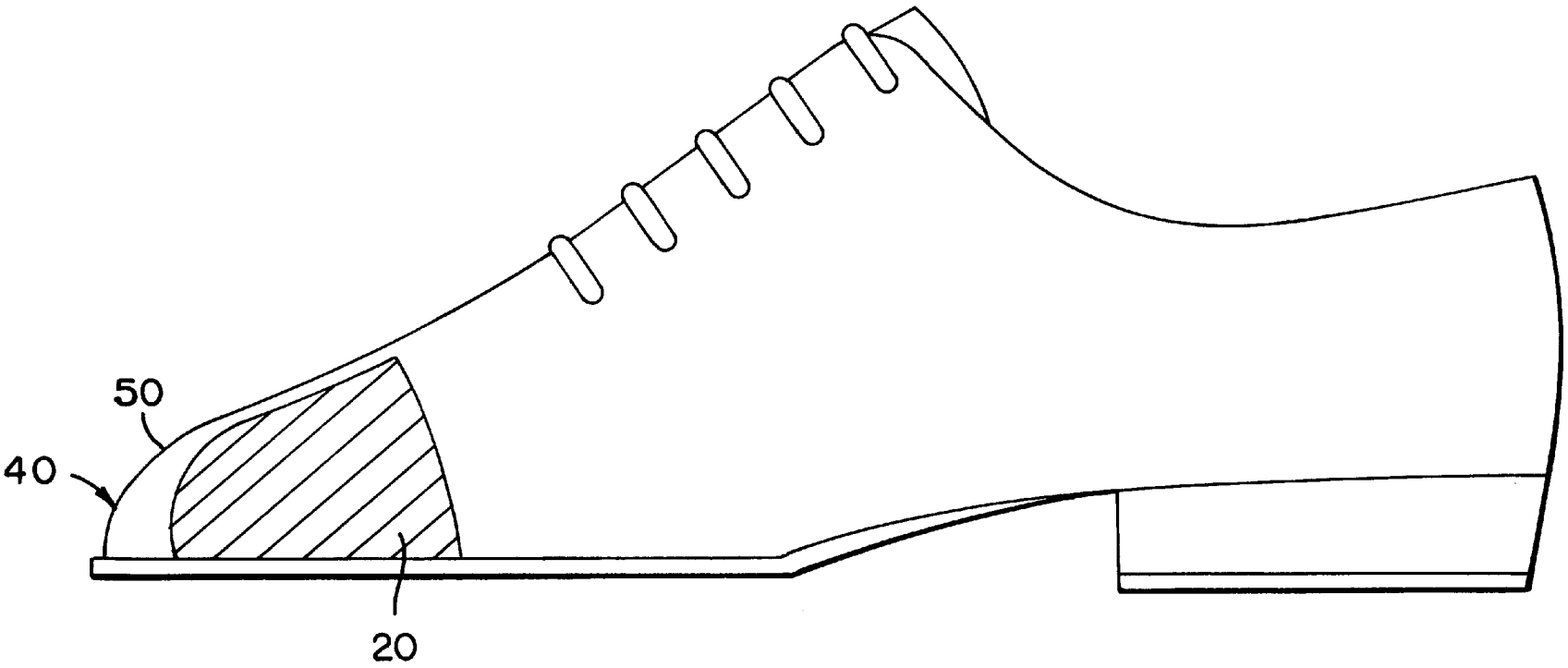
FIG. 7 is a partial cross-sectional side-view of a shoe having a transparent toe piece and configured in accordance with the present invention.
Figure 7B:
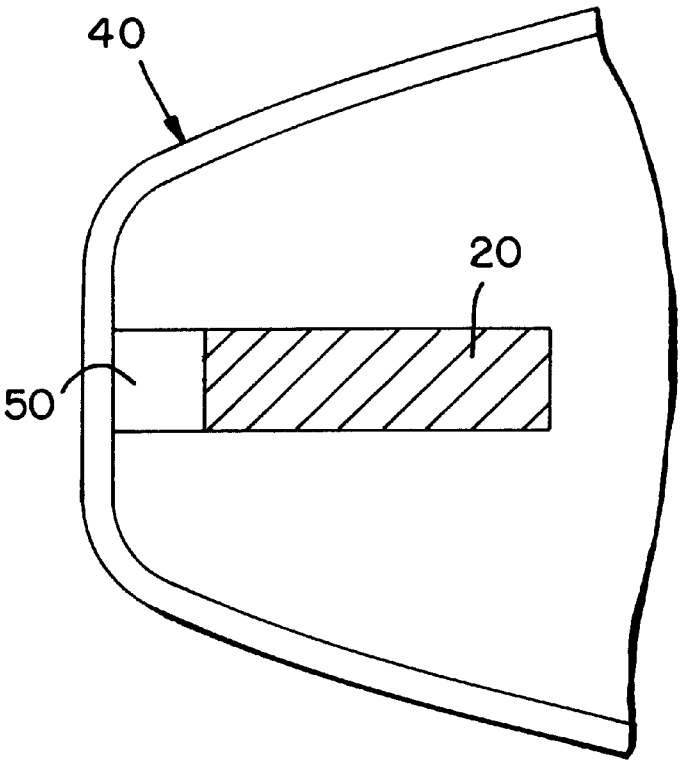
FIG. 7*b* is a top view of another embodiment of a shoe having a transparent toe piece.
Figure 7A:
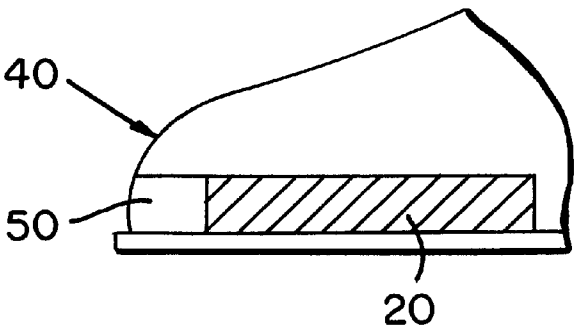
FIG. 7*a* is a side view of another embodiment of a shoe having a transparent toe piece.
Figure 8:
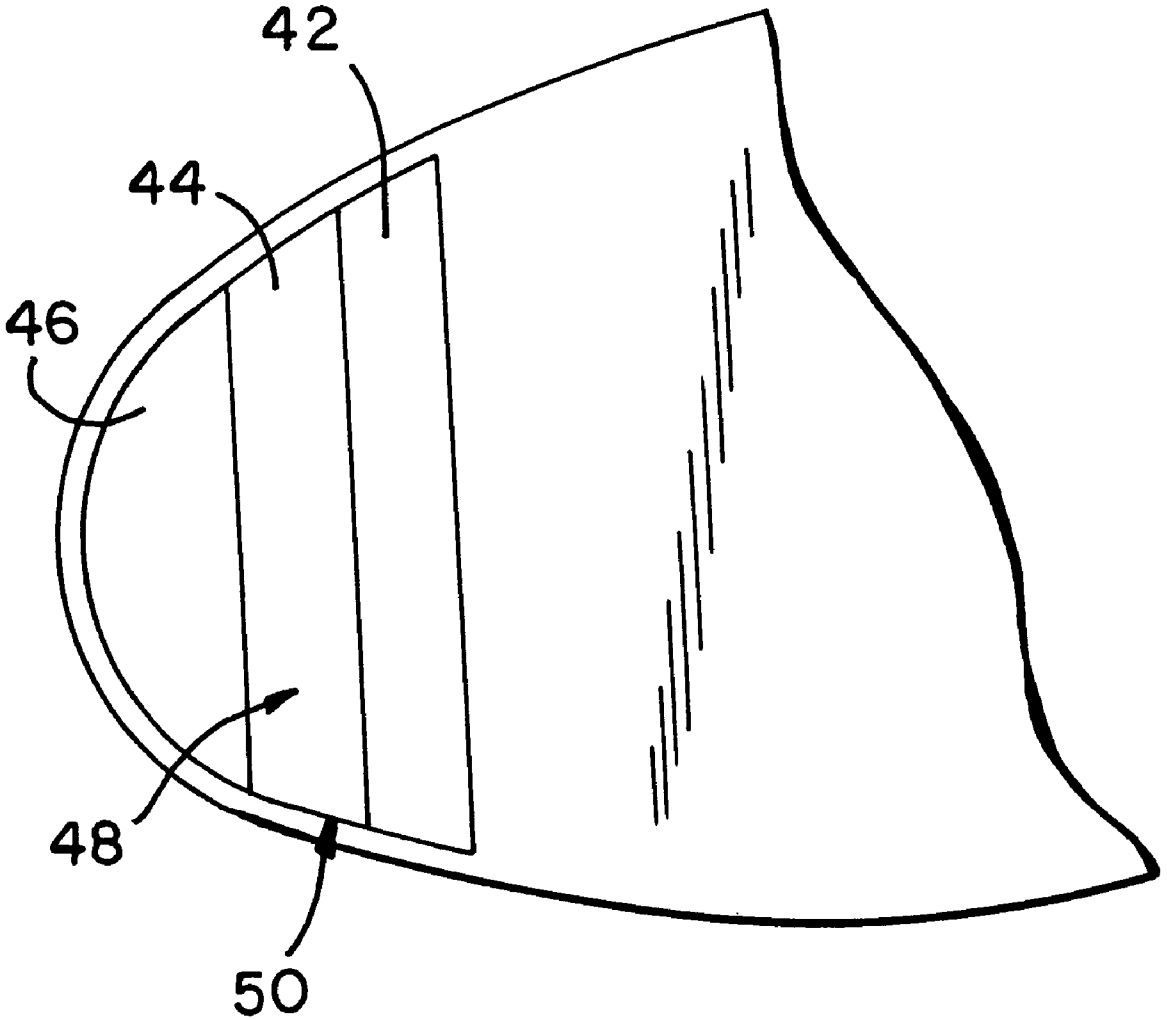
FIG. 8 is a partial top view of the shoe of FIG. 7 depicting a fit indicator visible through the transparent toe piece.

Referring next to the embodiment shown in FIGS. 7, 7*a*, 7*b*, and 8, the toe portion 40 of the shoe 10 may include a transparent toe piece 50 that permits the wearer or other person to visually approximate the fit of the shoe. A fit indicator 48 (See FIG. 8) may be provided near the toe portion 40 upon which the wearer's foot may rest so as to be visible through the transparent toe piece 50. A plurality of foot size indicators or lines 42, 44, 46 on the fit indicator 48 provide a visual indication of the size of the wearer's foot. The plural indicators 42, 44, 46 may be colored, shaded, or otherwise identifiably differentiated. For example, indicator 42 may be green to indicate that the wearer's foot may grow two shoe sizes before the shoe must be replaced, indicator 44 may be yellow to indicate one shoe size of growth remains, and indicator 46 may be red to indicate that the shoe should be replaced. Referring to FIG. 7, the toe piece 50 covers most of the toe portion 40. FIGS. 7*a* and 7*b* show optional embodiments of toe piece which include a transparent strip positioned on the toe portion 40 of the shoe for ascertaining be fit of the shoe. In FIG. 7*a*, the toe piece 50 is disposed on a side of the top portion 40, and in FIG. 7*b*, the toe piece 50 is disposed on a top of the toe portion 40. Thus, in accordance with this embodiment of the present invention, the wearer or another person may easily ascertain the amount of space remaining between the tips of the wearer's toes and the tip of the shoe to readily determine when it is necessary to replace the shoes.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention.

I claim:

1. A self-adjusting shoe for accommodating a range of foot sizes, comprising:

a sole having a toe portion and a heel portion;

a shoe upper extending from said toe portion to said heel portion and affixed to said sole and having an opening with a topline;

a sock-type unit comprising a counter arranged at said heel portion and an expansible element connected to said counter and extending to said toe portion, said expansible element connected to said shoe upper along said topline of said opening in said shoe upper, said counter connected to said heel portion of said sole, said expansible element expandable from a non-expanded state to a fully expanded state for expandably receiving a first portion of the wearer's foot and supportably holding a second portion of the wearer's foot against said counter, and said expansible element being operatively expandable for supportably receiving a range of foot sizes from a smallest foot size to a largest foot size, said range spanning at least one standard shoe size; and said sole comprising a surface facing said expansible element, said surface operatively arranged for creating a large coefficient of friction with said expansible element thereby limiting a sliding movement of the wearer's foot received in said expansible element relative to said surface during use of said shoe.

2. The self-adjusting shoe of claim 1, wherein said expansible element comprises a collar lining portion, an expansible vamp lining connected to said collar lining portion and said counter, and an expansible insole, said expansible vamp lining connected with said expansible insole for forming a toe portion of said sock-type unit and said collar lining of said expansible element being connected to said topline of said opening of said shoe upper, wherein said expansible vamp lining and said expansible vamp insole are expandable together to supportably receive the range of foot sizes.

3. The self-adjusting shoe of claim 2, wherein said expansible insole extends from said toe portion to a middle portion between said toe portion and said heel portion, an end of said expansible insole facing said heel portion being connected to said sole at said middle portion.

4. The self-adjusting shoe of claim 1, wherein said shoe upper and said shoe sole are larger than said expansible element at said toe portion, thereby permitting an expansion of said expansible lining proximate said toe portion.

5. The self-adjusting shoe of claim 1, wherein said expansible element comprises a four-way stretch elasticized meshed fabric.

6. The self-adjusting shoe of claim 1, wherein said largest foot size is approximately two standard shoe sizes larger than said smallest foot size.

7. The self-adjusting shoe of claim 1, wherein said largest foot size within the range is approximately ¼ inch to approximately 5/16 inch longer than said smallest foot size.

8. The self-adjusting shoe of claim 1, further comprising a transparent toe piece mounted on said shoe upper proximate said toe portion for permitting a visual approximation of an amount of expansion of said expansive element.

9. The self-adjusting shoe of claim 8, further comprising a fit indicator mounted in said shoe proximate said toe portion such that said fit indicator is visible through said transparent toe piece.

10. The self-adjusting shoe of claim 9, wherein said fit indicator comprises a plurality of foot size indicators for indicating a size of the wearer's foot.

11. The self-adjusting shoe of claim 1, wherein said sole comprises a midsole and an outsole, said expansive element being affixed to said midsole at a location between said toe portion and said heel portion.

12. The self-adjusting shoe of claim 11, wherein said midsole comprises said surface facing said expansible element operatively arranged for creating a large coefficient of friction with said expansible thereby limiting a sliding movement of said expansible element on said surface.

13. The self-adjusting shoe of claim 12, wherein said expansible insole extends from said toe portion to a middle between said toe portion and said heel portion, an end of said expansible insole facing said heel portion being connected to said midsole at said middle portion.

14. The self-adjusting shoe of claim 13, wherein said midsole comprises aid surface facing said expansible element operatively arranged for creating a large coefficient of friction with said expansible element thereby limiting a sliding movement of said expansible element on said surface.

15. The self-adjusting shoe of claim 14, wherein said surface comprises suede for limiting a sliding movement of said expansive insole on said surface.

16. The self-adjusting shoe of claim 14, wherein said surface comprises projections for limiting a sliding movement of said expansive insole on said surface.

17. The self-adjusting shoe of claim 14, wherein said surface comprises depressions for limiting a sliding movement of said expansive insole on said surface.

18. The self-adjusting shoe of claim 12, wherein said surface comprises suede.

19. The self-adjusting shoe of claim 12, wherein said surface comprises projections for limiting a sliding movement of said expansive lining on said surface.

20. The self-adjusting shoe of claim 12, wherein said surface comprises depressions for limiting a sliding movement of said expansive lining on said surface.

21. The self-adjusting shoe of claim 11, wherein said expansible element comprises a collar lining portion, an expansible vamp lining connected to said collar lining portion and said counter, and an expansible insole, said expansible vamp lining connected with said expansible insole for forming a toe portion of said sock-type unit and said collar lining of said expansible element being connected to said topline of said opening of said shoe upper.

22. The self-adjusting shoe of claim 1, further comprising an expansive counter comprising a plurality of upwardly extending fingers connected to said sole, said plural fingers permitting an expansion of said heel portion for accommodating growth of the wearer's foot.

* * * * *